United States Patent [19]

Bretzger

[11] 4,231,413

[45] Nov. 4, 1980

[54] ASSEMBLY FOR AND METHOD OF MAKING MOLD AND CASTING OF ONE-PIECE IMPELLERS

[76] Inventor: Graham Bretzger, 1105 Skymont Rd., Staunton, Va. 24401

[21] Appl. No.: 15,589

[22] Filed: Feb. 27, 1979

[51] Int. Cl.[3] ..... B22C 7/00; B22C 9/22

[52] U.S. Cl. ..... 164/15; 164/45; 164/245; 264/220; 264/313

[58] Field of Search ..... 164/15, 6, 23, 45, 245; 264/313, 220, 219, 225

[56] References Cited

U.S. PATENT DOCUMENTS

| | | | |
|---|---|---|---|
| 716,870 | 12/1902 | Crecelius | 164/23 |
| 2,702,418 | 2/1955 | Miner | 164/23 |
| 3,848,654 | 11/1974 | Boyle et al. | 164/45 X |
| 4,066,116 | 1/1978 | Blazek et al. | 164/23 X |
| 4,139,046 | 2/1979 | Stanciu | 164/45 |

FOREIGN PATENT DOCUMENTS

| | | | |
|---|---|---|---|
| 38-2953 | 4/1963 | Japan | 164/15 |
| 6752 | 10/1898 | Norway | 164/15 |
| 14516 | of 1891 | United Kingdom | 164/15 |

*Primary Examiner*—Robert D. Baldwin
*Assistant Examiner*—J. Reed Batten, Jr.
*Attorney, Agent, or Firm*—Kenyon & Kenyon

[57] ABSTRACT

A method of preparing an assembly and an assembly useful in making a mold for casting one-piece impellers in which a master model of one of the vanes of the impeller is made in a polished metal having, on its inner end a shoulder with a height and depth approximately equal twice the width of the vane at its inside edge, the vane being tapered from inside to outside; from the master model a plurality of identical, flexible vanes are prepared from a material selected from the group consisting of flexible rubber and flexible plastic; a member having a truncated conical part containing therein a plurality of slots sized to match the inner edge of the vanes and a base plate having a plurality of slots therein equal in number to the slots in the truncated conical part with the slots in the truncated conical part and the base plate in alignment is formed; the flexible vanes are inserted from inside the truncated conical part through the slots therein with the bottom portion of the vanes in the slots in the base plate; and a core having a truncated conical shape concentric therewith inserted inside the truncated conical part in abutment with the shoulders on the vanes holding the shoulders in contact with the inside of the truncated conical part. Also disclosed is a method of making a mold from the assembly and casting with the mold so made.

13 Claims, 6 Drawing Figures

ASSEMBLY FOR AND METHOD OF MAKING MOLD AND CASTING OF ONE-PIECE IMPELLERS

BACKGROUND OF THE INVENTION

This invention relates to casting in general and, more particularly, to a method of making a mold for casting and a method of casting a pump impeller or the like in one piece.

Various methods have been developed for casting impellers and other similar devices which include a curved blade structure. Casting methods are described in the Metals Handbook, 8th Edition, Volume 5, entitled Forging and Casting, particularly at page 222 et seq. In it are disclosed a number of methods of casting devices such as impellers, wheels having angular vanes and the like. Of particular interest is the disclosure on page 223 of the use of flexible rubber patterns. These are noted as being useful in making molds for casting wheels having angular vanes. As described, the use of flexible rubber patterns permits patterns having as much as 30° negative drift to be withdrawn without damaging molds that have high green strength.

Despite recognition of the usefulness of flexible molds, the majority of the teaching relating to the construction of impellers describes the use of separate vane cores when making a device of this nature. Obviously, the use of a plurality of such cores makes the process much more difficult. It, thus, becomes evident that there is a need for an improved method of casting an impeller in one piece.

SUMMARY OF THE INVENTION

The present invention provides such a method. In accordance with the present invention, a master model of a vane, of which there will be a plurality in the impeller, is made in a non-ferrous metal with a polished finish. There are literally no restrictions as to the contour of the vane. The only requirement is that the blade must be tapered from the inside edges to the outside edges. In accordance with the present invention, the vane contains a shoulder at its inner edge approximately two times the thickness of the vane in width and depth.

The master model is then used in making one or more molds out of plaster or ceramic. These holes are used to make production models of the vane. From the production models, which should be of the same size and weight and highly polished when finished, dies are then made from which rubber or flexible plastic reproductions are then made.

A circular sheet of aluminum of suitable thickness having slots of the exact size and shape to receive the vanes is then cut. The aluminum slotted sheet is formed into a truncated conical part of the size and shape desired. A second aluminum sheet is provided with slots adapted to receive the lower edge of each vane, the slots radiating out from the center and spaced equally on a circle. This sheets forms a base plate, which is assembled to the truncated conical part whereafter the individual vanes are inserted through the slots with their shoulders abutting against the inside of the truncated conical part and their lower edges lying in the slots in the base plate. A metal core is inserted inside the slotted truncated conical part which presses against the shoulders of the vanes to maintain them in alignment.

The assembly is then placed on a metal base and an aluminum ring placed therearound with a diameter about one inch larger than the diameter of the assembly and a height slightly lower than the top of the rubber vanes. After lubrication with a thin mixture of castor oil and alcohol, molding with a commercial investment mix and very heavy consistency is carried out with vibration and the investment casting material poured slowly to the height of the aluminum ring. When the investment is hardened, the base on which the assembly has been resting is removed, the core removed from inside the truncated conical part and the flexible rubber vanes then removed. The truncated conical part itself can then be removed and the excess investment casting material cleaned out. The mold is then heated in conventional fashion to the required temperature.

The mold is then used in casting the impeller with the mold placed between a suitable back-up plate of a refractory material and another top plate of the same type of material, to which is attached a pouring spout. In conventional fashion, the top and bottom plates are vented to allow the escape of air from each vane as the metal enters the cavity. After cooling, the plates and the mold are removed to give the complete onepiece metal casting.

In the case of ferrous casting, when making the mold, any conventional technique can be used. However, it is important to cover all rubber vanes completely with slurry. Once again, after the mold has hardened, the base is removed, the core removed and then all the rubber vanes and the truncated conical part. The mold is dried in conventional fashion, and top and bottom ceramic plates again used for casting.

DETAILED DESCRIPTION OF THE INVENTION

Figure 1:
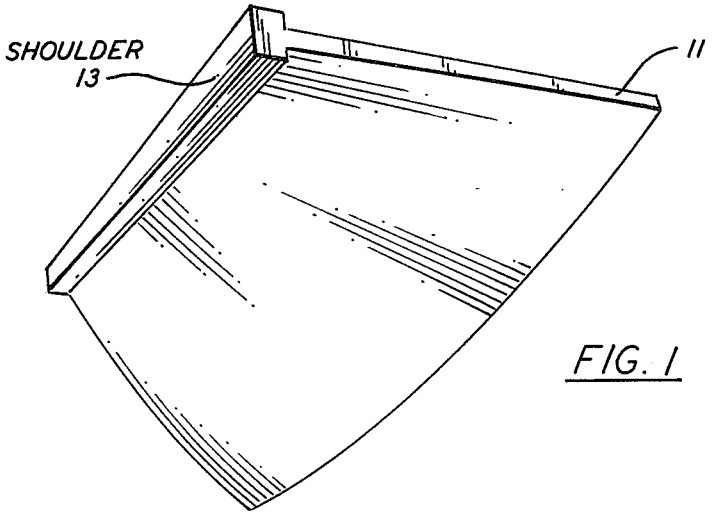
FIG. 1 is a perspective view of a vane used in the method of the present invention.

In accordance with the present invention, in order to make an assembly from which a mold can be made which can, in turn, be used for casting a one-piece impeller, a master model of one of the impeller vanes is first made in a non-ferrous metal with a polished finish. Such a vane is shown in perspective view in FIG. 1. In addition to having the proper shape, on which there are not restrictions, i.e., any amount of curvature which is required can be used, the vane is provided with a shoulder 13 having a width and depth approximately twice the width of the vane at its base. The vane 11 does have to have a taper from its inside edge to its outside edge. The shoulder 13 is used in establishing a uniform position for all of the vanes in a manner that will be described more fully below.

The master model of the vane is then used to make a production model of the vane. It should be made slightly oversized to allow for shrinkage. As many production models as desired can be cast from the finished master model to speed up production. Plastic or ceramic molds for casting production models have proven most satisfactory. Production models should be the same size and weight and should be highly polished when finished. From the production models, dies are then made for casting rubber or flexible plastic reproductions of the vanes. When finally cast in a flexible rubber or flexible plastic, the vane will have the same shape as the vane 11 of FIG. 1, including the shoulder 13. A plurality of such vanes will, of course, be produced.

Figure 2:
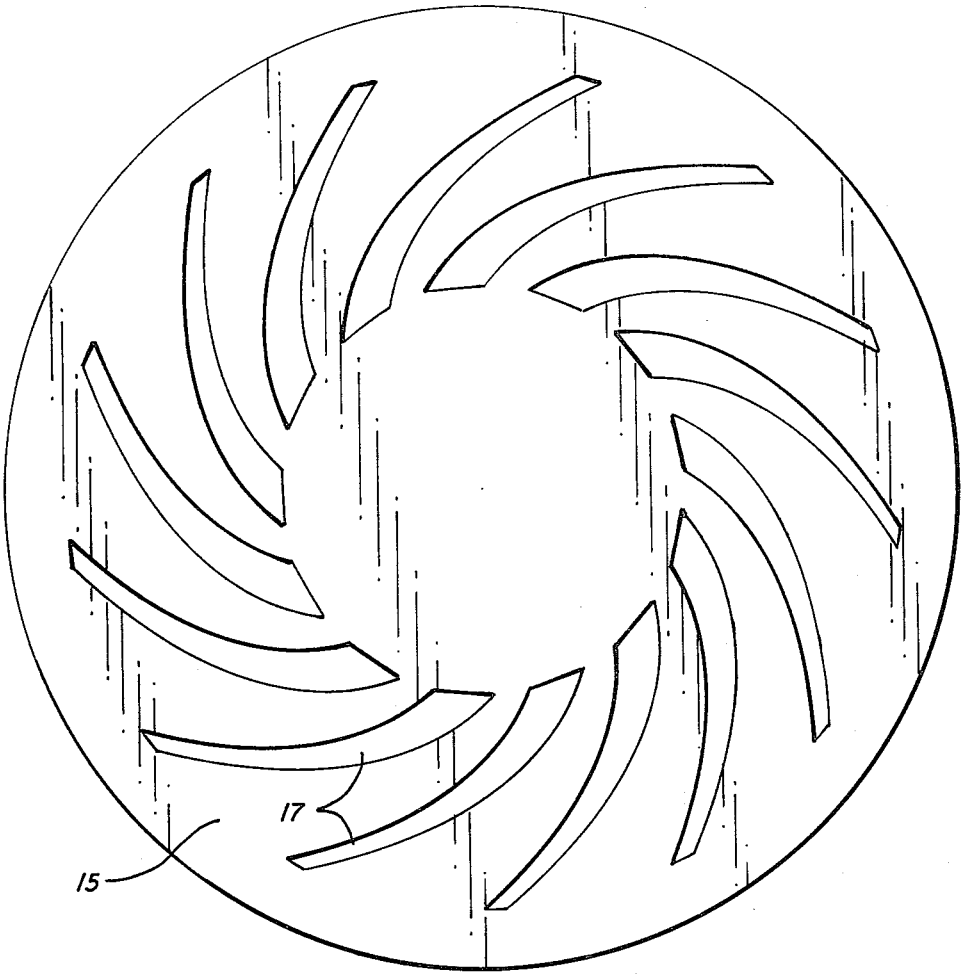
FIG. 2 is a plan view of a stamped disc containing cut-outs which is used for making a truncated conical part for use in the present invention.

The next step in the process of the present invention is the preparation of a stamped disc such as illustrated in FIG. 2. A disc 15 of aluminum of appropriate diameter has stamped therein a plurality of slots 17 of the required size and shape to receive the vanes.

Figure 3:
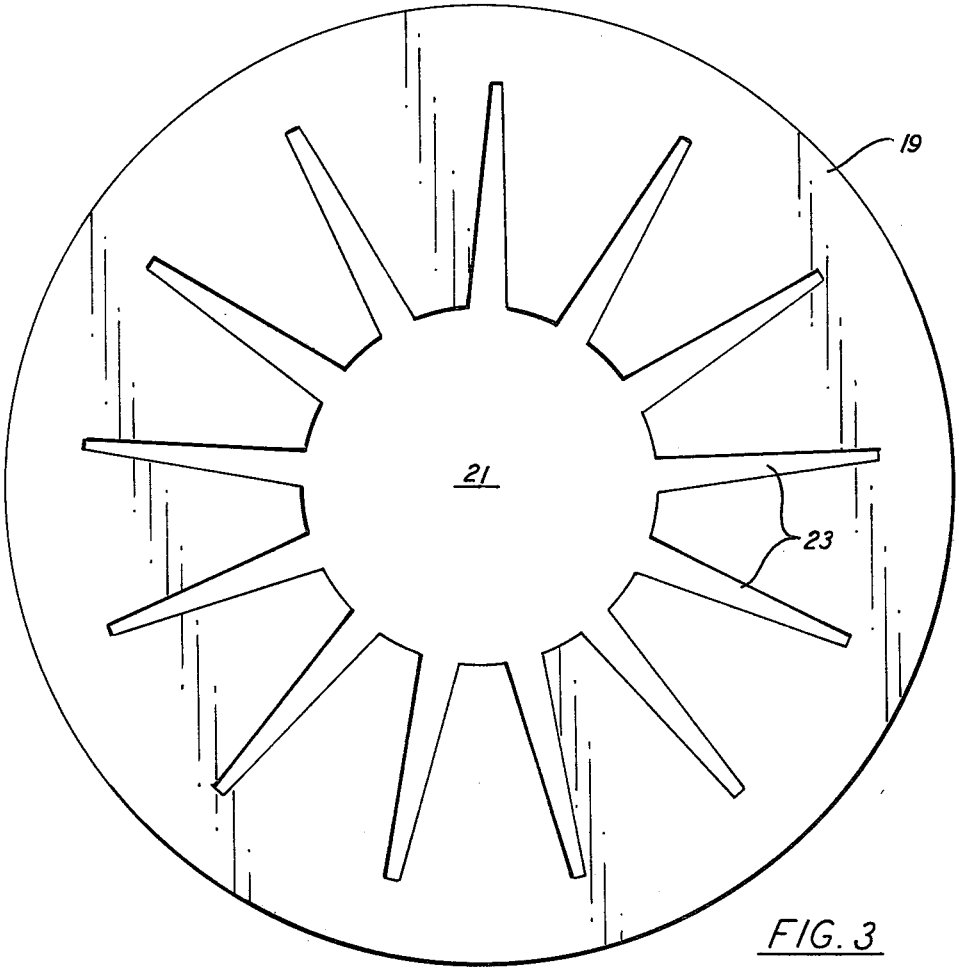
FIG. 3 is a plan view of a base plate having stamped cut-outs used in the present invention.
Figure 4:
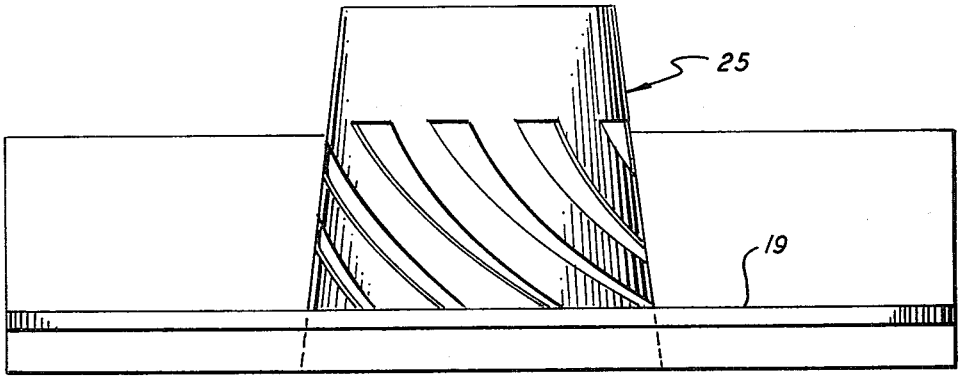
FIG. 4 is an elevation view showing the base plate assembled to the truncated conical part.
Figure 5:
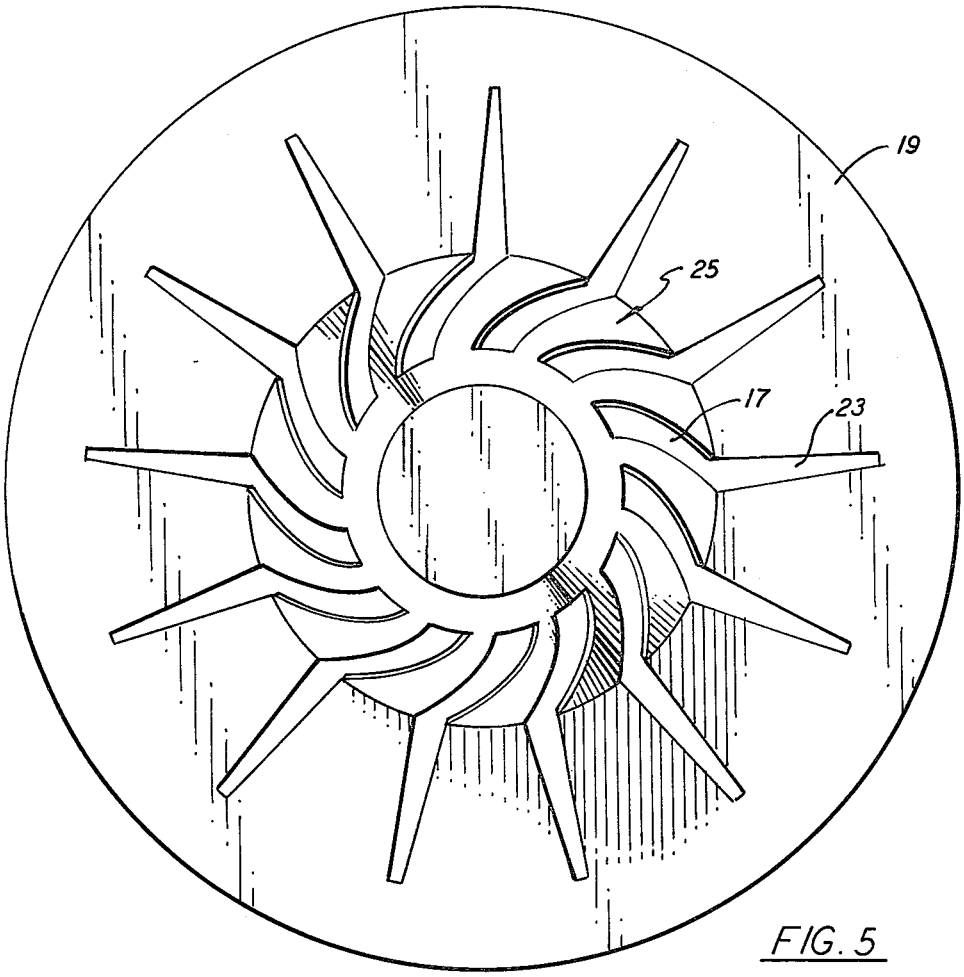
FIG. 5 is a plan view of the assembly of FIG. 4.

As shown in FIG. 3, an aluminum base plate 19 is stamped so as to have a central opening 21 with a plurality of radiating slots 23 equal in number to the slots 17 of the disc 15. The disc 15 is then formed into a truncated conical part 25 and the truncated conical part 25 so formed assembled to the base plate 19 with the slots aligned as is illustrated in FIGS. 4 and 5. It is also possible to form the whole assembly comprising the truncated conical part and base plate as a single piece.

Figure 6:
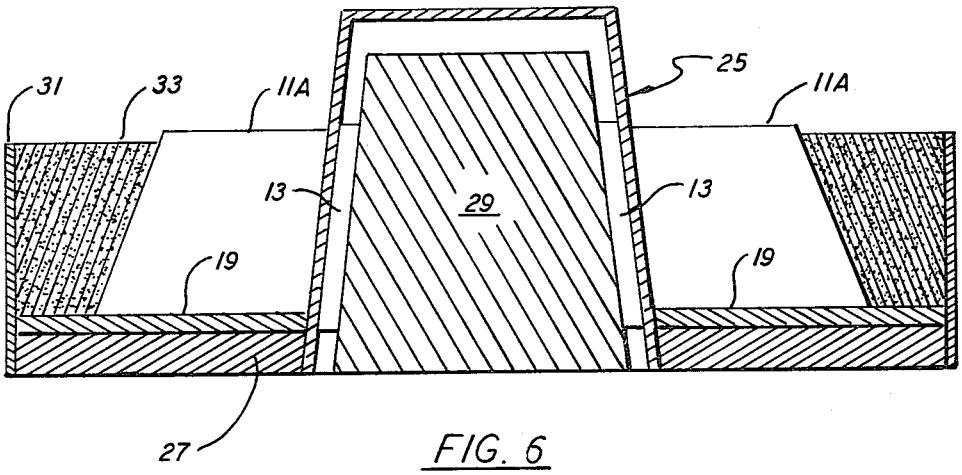
FIG. 6 is a cross-sectional elevation view of the assembly of FIGS. 4 and 5 with rubber vanes installed ready for the pouring of the mold material.

This assembly is now ready to accept the flexible rubber or plastic vanes 11A. As illustrated in FIG. 6, the vanes 11A are inserted into the slots 17 of truncated conical part 25 with the lower edges lying in the slots 23 of the base plate. The assembly including the rubber vanes 11A, truncated conical part 25 and aluminum base plate 19 is placed on a metal base 27. A metal core 29 concentric with the truncated conical part 25 is inserted inside the metal truncated conical part and abuts against the shoulders 13 of the vanes 11A bringing them into proper alignment. In other words, the core pushes the shoulder up against the inside of the metal truncated conical part, the vanes having been inserted through the slots therein from the inside. This completes the making of the assembly from which the mold is to be made.

In order to make a mold which can then be used for casting a single piece impeller, a metal ring 31 is placed around the remainder of the assembly. The ring should have a diameter about one inch larger than the maximum outside diameter of the assembly with the vanes 11A and should have a height slightly lower than the top of the rubber vanes 11A. At this point, it should be evident that in making the vanes, it is necessary that they be made slightly larger in height than the height desired in the finished impeller. Thereafter, the entire inside of the assembly is lubricated with a thin mixture of castor oil and alcohol to prepare it for casting.

If the mold is to be used with non-ferrous metals, a standard commercial investment casting mix can be used. It should be mixed to a very heavy consistency and then, while applying a vibration to the base plate, the mixture is poured slowly to the height of the ring 31. Alternatively, a vacuum casting method may be used. When the investment material 33 has hardened, metal base 27 is removed. The metal core 29 is then removed and the vanes 11A withdrawn. Thereafter, the metal truncated conical part 25 and base plate 19 can be removed, leaving only the mold. Thereafter, the excess investment material should be faced off from the top and bottom of the mold and the cavity in the mold flushed out with water or air to remove any excess investment material. The mold is then heated in an oven in a conventional fashion to the required casting temperature.

Casting is then carried out in the conventional fashion. A back-up plate of a refractory material is placed below the mold and a top plate of the same material, to which is attached a pouring spout, above it. In conventional fashion, the top and bottom plate should be vented to allow for the escape of air from each vane easily as the metal enters the cavity. If required, a conventional core may be used so that the hub of the impeller being made will be hollow. After cooling, the plates and the mold are removed to leave the one piece metal casting.

The only difference when making ferrous castings is that a casting material suitable for such castings will be used, as will conventional techniques for casting ferrous materials. It is important that all rubber vanes be completely covered with slurry making the mold. Once the mold is hardened, removal of the metal core, vanes, truncated conical part and base plate is as before. Similarly, once the mold has been dried, casting of the ferrous impeller is carried out in the same fashion.

I claim:

1. A method of preparing an assembly useful in making a mold for casting one-piece impellers comprising:

(a) making a master model for one of the vanes of the impeller in a polished metal having, on the inner end thereof, a shoulder with a height and depth approximately equal twice the width of the vane at its inside edge, said vane being tapered from inside to outside;

(b) preparing from said master model a plurality of identical, flexible vanes from a material selected from the group consisting of flexible rubber and flexible plastic;

(c) forming a member having a truncated conical part containing therein a plurality of slots sized to match the inner edge of the vanes and a base plate having a plurality of slots therein equal in number to the slots in said truncated conical part with said slots in said truncated conical part and said base plate in alignment;

(d) inserting said flexible vanes from inside said truncated conical part through the slots therein with the bottom portion of said vanes in the slots in said base plate; and (e) inserting inside said truncated conical part a core having a truncated conical shape concentric therewith, said core in abutment with said shoulders on said vanes holding said shoulders in contact with the inside of said truncated conical part.

2. The method according to claim 1 wherein said step of forming said truncated conical part and base plate comprises stamping from aluminum a circular piece containing therein said slots; forming said circular piece into a truncated conical part; forming said base plate by stamping said base plate as a circular member with a central opening and slots; and inserting said truncated conical part in said base plate.

3. The method according to claim 1 wherein said base plate and truncated conical part are stamped as a single member.

4. The method according to claim 1 and further including making a mold using said assembly by steps comprising:

(a) supporting the assembly including said base plate, said truncated conical part, said vanes, and said core on a metal base;

(b) placing around said assembly a ring having a diameter approximately one inch greater than the outside diameter of said assembly and having a height slightly less than the height of said vanes above said base plate;

(c) lubricating the area inside said ring;

(d) pouring a molding material into the area inside the ring, up to the level thereof;

(e) when said molding material has hardened to form a mold, removing said assembly from said base, removing said core, withdrawing said vanes, removing said truncated conical part and base plate, and removing said ring; and (f) drying said mold completely.

5. The method according to claim 4 wherein said molding material comprises a commercial investment casting mix prepared to a heavy consistency and wherein said step of drying comprises heating said mold in an oven at a predetermined temperature.

6. The method according to claim 5 wherein said step of lubricating comprises lubricating with a mixture of castor oil and alcohol.

7. The method according to claim 4 and further including the step of casting a one-piece impeller assembly from said mold by steps comprising:

(a) placing said mold on a ceramic refractory of backing plate;

(b) covering said mold with a top plate of a similar refractory material containing therein a pouring spout;

(c) pouring metal into the cavity of said mold between said backing and top plates;

(d) venting said cavity so as to permit venting each vane space; and (e) after cooling remove said plates and said mold.

8. The method according to claim 7 and further including the step of preparing a core and inserting said core in the central opening of said mold between said backing and top plates.

9. The method according to claim 4 and further including the steps of facing off excess investment material from the top and bottom of said mold and flushing out the mold cavity remaining after removal of said core, vanes and truncated conical part to remove excess molding material.

10. An assembly which can be used for making a mold which permits casting a one-piece impeller with vanes comprising:

(a) a first member which includes a base plate section and extending upwardly therefrom a truncated conical section, said truncated conical section having formed therein a plurality of slots having a size, shape and location corresponding to the size, shape and location of the inner ends of the vanes of the impeller to be casted, said base plate section also having therein radial slots in alignment with the slots in said truncated conical section;

(b) a plurality of flexible vanes inserted in said slots each having a shoulder at its inner end; and (c) a core concentric with said truncated conical section inserted therein in abutment with said shoulders maintaining them in contact with the inside of said truncated conical section.

11. The assembly according to claim 10 and further including a base member on which said base plate section is supported and a metal ring encircling said assembly.

12. The assembly according to claim 11 wherein said base plate and truncated conical sections are made of aluminum.

13. The assembly according to claim 12 wherein said truncated conical section is a first stamped and formed piece and said base plate section a second stamped piece into which said truncated conical section is inserted.

* * * * *